US009048058B2

(12) United States Patent
Yamazaki et al.

(10) Patent No.: US 9,048,058 B2
(45) Date of Patent: Jun. 2, 2015

(54) RADIATION GENERATING TUBE AND RADIATION GENERATING APPARATUS USING THE SAME

(71) Applicant: Canon Kabushiki Kaisha, Tokyo (JP)

(72) Inventors: Koji Yamazaki, Ayase (JP); Nobuhiro Ito, Yamato (JP); Kazuyuki Ueda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 13/678,169

(22) Filed: Nov. 15, 2012

(65) Prior Publication Data

US 2013/0129046 A1 May 23, 2013

(30) Foreign Application Priority Data

Nov. 18, 2011 (JP) ..... 2011-252500

(51) Int. Cl.
*H01J 35/02* (2006.01)
*H01J 35/16* (2006.01)

(52) U.S. Cl.
CPC ..... *H01J 35/02* (2013.01); *H01J 35/16* (2013.01); *H01J 2235/02* (2013.01); *H01J 2235/087* (2013.01)

(58) Field of Classification Search
USPC ..... 378/119, 121, 122, 136, 139
See application file for complete search history.

(56) References Cited

U.S. PATENT DOCUMENTS

| | | | | |
|---|---|---|---|---|
| 7,110,500 | B2 * | 9/2006 | Leek | 378/111 |
| 8,081,734 | B2 * | 12/2011 | Elam et al. | 378/121 |
| 2011/0255668 | A1 * | 10/2011 | Hoghoj et al. | 378/132 |

FOREIGN PATENT DOCUMENTS

| | | | |
|---|---|---|---|
| JP | 9-180660 | A | 7/1997 |
| JP | 2010-086861 | A | 4/2010 |

* cited by examiner

*Primary Examiner* — Nicole Ippolito
*Assistant Examiner* — Hanway Chang
(74) *Attorney, Agent, or Firm* — Canon USA Inc. IP Division

(57) ABSTRACT

A radiation generating tube, which includes: a cathode connected to an electron gun structure; an anode including a target and configured to generate radiation; and a tubular side wall disposed between the cathode and the anode to surround the electron gun structure; and an electrical potential defining member disposed at an intermediate portion of the tubular side wall between the anode and the cathode. The electrical potential defining member is electrically connected to an electrical potential defining unit via an electrical resistance member or an inductor, and a potential of the electrical potential defining member is defined to be a higher potential than a potential of the cathode and to be a lower potential than a potential of the anode.

16 Claims, 3 Drawing Sheets

RADIATION GENERATING TUBE AND RADIATION GENERATING APPARATUS USING THE SAME

BACKGROUND OF THE INVENTION

1. Field of the Invention

The present invention relates to a radiation generating tube which includes a transmission target. The present invention relates also to radiation generating apparatus in which the radiation generating tube is used.

2. Description of the Related Art

A transmission radiation generating tube is a vacuum tube including a cathode, an anode and an insulating tubular side wall. Electrons emitted from an electron source of the cathode are accelerated by high voltage applied between the cathode and the anode. The electrons collide with a transmission target on the anode and cause radiation to generate. The emitted radiation is extracted outside through a transmission target. The transmission target also functions as a radiation extraction window. Such a transmission radiation generating tube is used in radiation generating apparatus for medical and industrial use.

Such a transmission radiation generating tube and a reflective radiation generating tube have had a problem about how to improve their voltage withstanding capability. Japanese Patent Laid-Open No. 9-180660 describes a technique to improve voltage withstanding capability. In the described transmission radiation generating tube, a cathode-side end of an electron-focusing electrode is disposed between a tubular side wall and a cathode and is fixed thereto. A gap is formed between the tubular side wall and the focusing electrode. Since creepage distance of the tubular side wall is thus elongated, voltage withstanding capability is improved. Japanese Patent Laid-Open No. 2010-086861 and "Development of Portable X-ray Sources Using Carbon Nanostructures—A step toward X-ray nondestructive inspection and Rontgen examination using dry batteries as a power source" (Translation of AIST press release of Mar. 19, 2009) {http://www.aist-.go.jp/aist_e/latest_research/2009/20090424/ 20090424.html} each describe a technique to improve voltage withstanding capability by providing an intermediate potential electrode ("intermediate electrode") in a reflective radiation generating tube.

If, however, further improvement in voltage withstanding capability is desired in these techniques described above, the following problems may arise. In the technique described in Japanese Patent Laid-Open No. 9-180660, local potential of the tubular side wall is determined in accordance with a dielectric constant (or volume resistivity in certain cases) of the tubular side wall. There is, therefore, a possibility that electrical discharge occurs between the focusing electrode and an inner wall of the tubular side wall in some situations depending on the distance from the focusing electrode and from the inner wall of the tubular side wall. In the techniques described in Japanese Patent Laid-Open No. 2010-086861 and "Development of Portable X-ray Sources Using Carbon Nanostructures—A step toward X-ray nondestructive inspection and Rontgen examination using dry batteries as a power source", since the intermediate electrode protrudes further toward an inner space than an inner wall surface of the tubular side wall, electrons are emitted at an end portion of the intermediate electrode or from between a boundary of the intermediate electrode and the inner wall of the radiation generating tube. There is, therefore, a possibility that electrical discharge occurs between the intermediate electrode and the anode.

It occurred to the present inventors to suitably define the potential of the intermediate electrode in order to reduce the electrical discharge. However, there is still a possibility that electrical discharge occurs between the intermediate electrode and the focusing electrode or between the intermediate electrode and the electron source even in a structure in which the potential of the intermediate electrode is suitably defined. If electrical discharge occurs, the potential of the intermediate electrode may be lowered quickly. In some cases, depending on an electrification state of the tubular side wall, secondary electrical discharge may be caused between the anode and the focusing electrode, or between the anode and the cathode.

SUMMARY OF THE INVENTION

The present application describes exemplary embodiments of a radiation generating tube of high voltage withstanding capability. If electrical discharge occurs between an intermediate electrode and a focusing electrode, or an intermediate electrode and an electron source, the radiation generating tube of the present invention reduces a discharge current so as to prevent secondary electrical discharge caused by the electrical discharge. The present invention also describes radiation generating apparatus.

In accordance with at least one exemplary embodiment of the present invention, a radiation generating tube, includes: a cathode connected to an electron gun structure including an electron emitting portion; an anode including a target and configured to generate radiation when irradiated with electrons emitted from the electron emitting portion; and a tubular side wall disposed between the cathode and the anode to surround the electron gun structure; and an electrical potential defining member disposed at an intermediate portion of the tubular side wall between the anode and the cathode; wherein: the electrical potential defining member is electrically connected to an electrical potential defining unit via an electrical resistance member or an inductor, and a potential of the electrical potential defining member is defined to be a higher potential than a potential of the cathode and to be a lower potential than a potential of the anode.

According to the present invention: the electrical potential defining member is disposed at an intermediate portion of the tubular side wall of the radiation generating tube in the axis direction; the electrical potential defining member is electrically connected to the electrical potential defining unit via the electrical resistance member or the inductor; and the potential of the electrical potential defining member is defined to be higher potential than that of the cathode and to be lower than potential of the anode. Since the electrical resistance member or the inductor is disposed between the electrical potential defining member and the electrical potential defining unit, electrical discharge less easily occurs between the intermediate electrode and the focusing electrode or between the intermediate electrode and the electron source. Even when electrical discharge occurs between the intermediate electrode and the focusing electrode, or between the intermediate electrode and the electron source, the discharge current which flows into the focusing electrode or the electron source from the electrical potential defining member may be reduced. Therefore, it is possible to prevent occurrence of secondary electrical discharge which may be caused by electrical discharge between the intermediate electrode and the focusing electrode, or between the intermediate electrode and the electron source. Therefore, a radiation generating tube of high voltage withstanding capability and radiation generating apparatus capable of performing high energy output are provided.

Further features of the present invention will become apparent from the following description of exemplary embodiments with reference to the attached drawings.

DESCRIPTION OF THE EMBODIMENTS

Hereinafter, with reference to the drawings, preferred embodiments of a radiation generating tube and radiation generating apparatus of the present invention will be described in detail. Materials, dimensions, shapes, relative positions, etc., of the constituents of the embodiments described below are not intended to limit the invention unless otherwise stated.

Figure 1A:
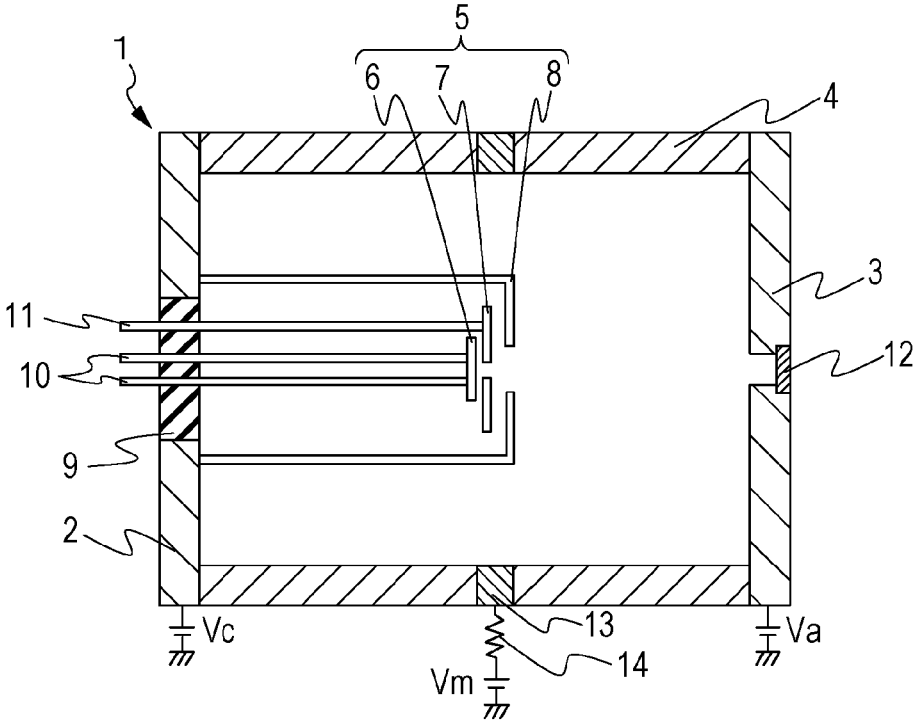
FIGS. 1A and 1B are schematic sectional views illustrating an exemplary radiation generating tube of the present invention.
Figure 1B:
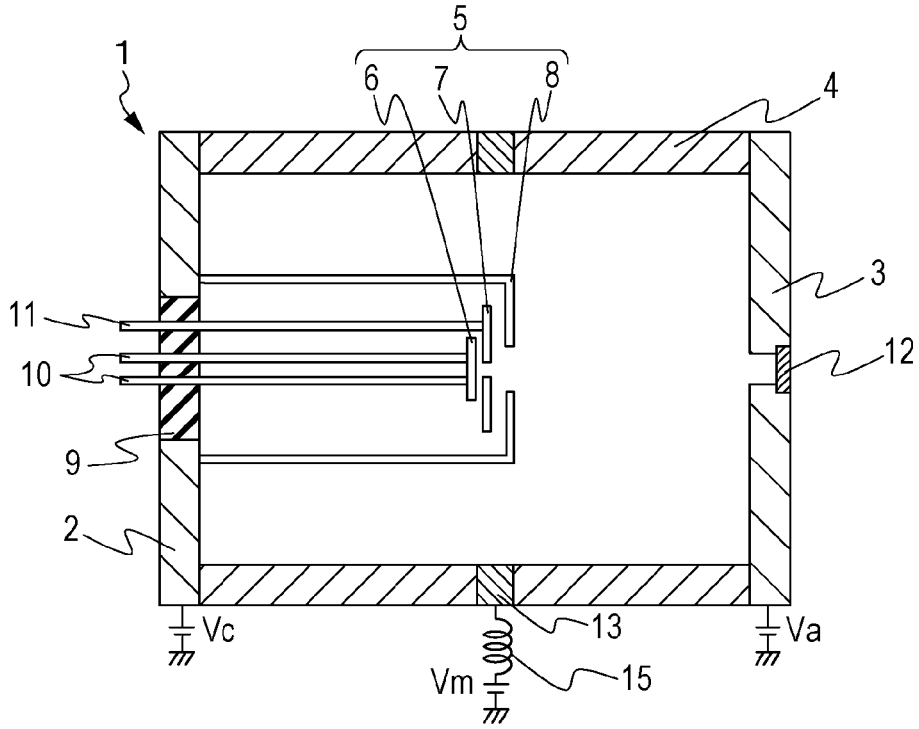

A configuration of the radiation generating tube of the present invention will be described with reference to FIGS. 1A and 1B. FIGS. 1A and 1B are diagrams illustrating, in schematic cross-sectional views, embodiments of the radiation generating tube of the present invention.

The radiation generating tube 1 is a vacuum tube which includes a cathode 2, an anode 3 and an insulating tube (hereafter, "tubular side wall") 4.

An electron gun structure 5 including an electron emitting portion is connected to the cathode 2. The electron gun structure 5 protrudes toward the anode 3. The electron gun structure 5 mainly includes an electron source 6, a grid electrode 7 and a focusing electrode 8.

The electron source 6 emits electrons. An electron emitting element of the electron source 6 may be either a cold cathode or a hot cathode. In the radiation generating tube of the present embodiment, an impregnated cathode (hot cathode), which is capable of reliably extracting high current, may be suitably selected as the electron source. The impregnated cathode emits electrons when heated by a heater. The heater is provided near the electron emitting portion of the impregnated cathode and is supplied with current to heat the impregnated cathode.

Predetermined voltage is applied to the grid electrode 7 for the extraction, in the vacuum, of the electrons emitted from the electron source 6. The grid electrode 7 is disposed at a predetermined distance from the electron source 6. The shape, the diameter, the aperture ratio, etc., of the grid electrode 7 are determined in consideration of extraction efficiency of the electrons and exhaust air conductance in the vicinity of the cathode 2. Desirably, for example, the grid electrode 7 is a tungsten mesh of about 50 micrometers in wire diameter.

The focusing electrode 8 controls expansion of an electron beam (i.e., a beam diameter) which has been extracted by the grid electrode 7. Typically, the beam diameter is adjusted by the voltage of about hundreds of volts to several kV applied to the focusing electrode 8. The electron beam may be converged by only the lens effect caused by an electric field as long as the structure in the vicinity of the electron source 6 is suitably established and the voltage is suitably applied. In such a case, it is not necessary to provide the focusing electrode 8.

The cathode 2 includes an insulating member 9. A terminal for driving the electron source 10 and a terminal for grid electrode 11 are fixed to the insulating member 9 and thus are electrically insulated from the cathode 2. The terminal for driving the electron source 10 and the terminal for grid electrode 11 extend toward the cathode from the electron source 6 and the grid electrode 7, respectively, in the radiation generating tube 1, and are extracted out of the radiation generating tube 1. The focusing electrode 8 is directly fixed to the cathode 2 and is at the same potential with that of the cathode 2. In an alternative configuration, the focusing electrode 8 may be insulated from the cathode 2 and may be at different potential from that of the cathode 2. In this case, the potential of the focusing electrode 8 may be determined so that the electrons emitted from the electron source 6 efficiently collide with a target 12.

The anode 3 includes the target 12 which emits radiation when irradiated with an electron beam of predetermined energy. Voltage of several tens of kV to about 100 kV is applied to the anode 3. The electron beam generated by the electron source 6, emitted from the electron emitting portion and extracted by the grid electrode 7 is guided by the focusing electrode 8 toward the target 12 on the anode 3. The electron beam is then accelerated by the voltage applied to the anode 3 and made to collide with the target 12, whereby radiation is generated. The generated radiation is radiated in all directions: among them, the radiation having passed through the target 12 is extracted out of the radiation generating tube 1.

The target 12 may include a target layer and a substrate which supports the target layer. Alternatively, the target 12 may only include a target layer. The target layer generates radiation when an electron beam collides therewith. The substrate transmits radiation. If the target 12 includes a target layer and a substrate, the target layer is disposed on a surface of the substrate which is irradiated with the electron beam (i.e., a surface of the substrate on the side of the electron gun structure). Typically, the target layer includes target metal which is made of elements of atomic number 26 or higher. Namely, a thin layer made of, for example, tungsten, molybdenum, chromium, copper, cobalt, iron, rhodium and rhenium or alloys thereof may be used suitably as target metal. The target layer is formed by physical processes, such as sputtering, to obtain a fine film structure. The optimum thickness of the target layer is not uniformly defined because the electron beam permeation depth, i.e., an area in which the radiation is generated, differs depending on the acceleration voltage. Typically, the thickness of the target layer is several micrometers to about 10 micrometers when acceleration voltage of about 100 kV is applied. The substrate needs to be high in radiation transmittance, high thermal conductivity and needs to withstand vacuum-sealing. For example, diamond, silicon nitride, silicon carbide, aluminum carbide, aluminum nitride, graphite and beryllium may be suitably used. Diamond, aluminum nitride and silicon nitride are more suitable because these materials are high in radiation transmittance and higher in thermal conductivity than tungsten. Among these, diamond is more suitable for its high thermal conductivity, radiation transmittance, and capability of keeping the vacuum state. The thickness of the substrate may be determined so that the function described above is carried out. Desirably, the thickness of the substrate is 0.1 mm or more to 2 mm or less depending on the material. The target 12 is fixed to the anode 3 desirably by, in addition to a thermal process, brazing or welding in consideration of keeping a vacuum state.

The tubular side wall 4 is formed by an insulating member, such as glass and ceramic. The tubular side wall 4 is disposed between the cathode 2 and the anode 3 to surround the electron gun structure 5. The tubular side wall 4 is fixed, at both ends thereof, to the cathode 2 and the anode 3 by brazing or welding. The shape of the tubular side wall 4 is not particularly limited as long as it is suitable to form a vacuum tube. However, a cylindrical shape is desirable from the viewpoint of reduction in size or ease in manufacture. If air is exhausted from the radiation generating tube 1 with the application of heat in order to increase a degree of vacuum in the radiation generating tube 1, the cathode 2, the anode 3, the tubular side wall 4 and the insulating member 9 are desirably made of materials with close coefficient of thermal expansion. For example, the cathode 2 and the anode 3 are desirably made of Kovar or tungsten, and the tubular side wall 4 and the insulating member 9 are desirably made of borosilicate glass or alumina.

In the above-described radiation generating tube 1, the focusing electrode 8 is closest to the tubular side wall 4 among other electrodes disposed on the cathode side. In such a case, voltage withstanding capability of the radiation generating tube 1 may be further improved by increasing voltage withstanding capability in the space between the tubular side wall 4 and the focusing electrode 8. Voltage withstanding capability in the space may be increased by reducing field intensity between the tubular side wall 4 and the focusing electrode 8. As a means to reduce field intensity without increasing the size of the radiation generating tube, an electrical potential defining member 13 is provided at an intermediate portion of the tubular side wall 4 in the axis direction. Potential of the electrical potential defining member 13 is defined suitably. Hereinafter, a configuration provided with the focusing electrode 8 will be described with reference to FIGS. 1A and 1B. However, the focusing electrode 8 may be replaced by another member, such as the grid electrode 7, which constitutes the electron gun structure 5. The grid electrode 7 is not necessarily provided depending on the configuration of the electron source 6: in such a case, the grid electrode 7 may be replaced by other constituents of the electron gun structure 5.

Potential of the electrical potential defining member 13 is defined such that no electrical discharge occurs between the focusing electrode 8 and the electrical potential defining member 13. However, there is a possibility that burr formed in the manufacturing process or foreign substances adhering to the electrical potential defining member 13 may cause electrical discharge. In this case, the potential of the electrical potential defining member 13 approaches the potential of the focusing electrode 8 in a short time. This may cause, depending on an electrification state of the tubular side wall 4, secondary electrical discharge between the anode and the focusing electrode or between the anode the cathode. The electrical potential defining member 13 is electrically connected to an electrical potential defining unit via an electrical resistance member 14 (FIG. 1A) or an inductor 15 (FIG. 1B) in order to prevent occurrence of the secondary electrical discharge. The potential of the electrical potential defining member 13 is desirably defined to be higher potential than that of the cathode 2 and to be lower potential than that of the anode 3. If electrical discharge occurs between the electrical potential defining member 13 and the focusing electrode 8, the electrical resistance member 14 or the inductor 15 may reduce the discharge current which flows into the focusing electrode 8 from the electrical potential defining member 13. Therefore, secondary electrical discharge in the vicinity of the tubular side wall 4 due to electrification thereof may be prevented. The electrical resistance member 14 or the inductor 15 may be suitably disposed in accordance with the use. Typical examples thereof are as follows.

The first method is to dispose the electrical resistance member 14 or the inductor 15 outside the radiation generating tube 1. The merit of this method is improved maintenance. If it should discharge, the electrical resistance member 14 or the inductor 15 may suffer damage from the discharge current, but it is less possible that the radiation generating tube itself becomes defective. Therefore, since the damaged electrical resistance member 14 or inductor 15 may be replaced, deterioration of the radiation generating apparatus may be prevented.

Figure 2:
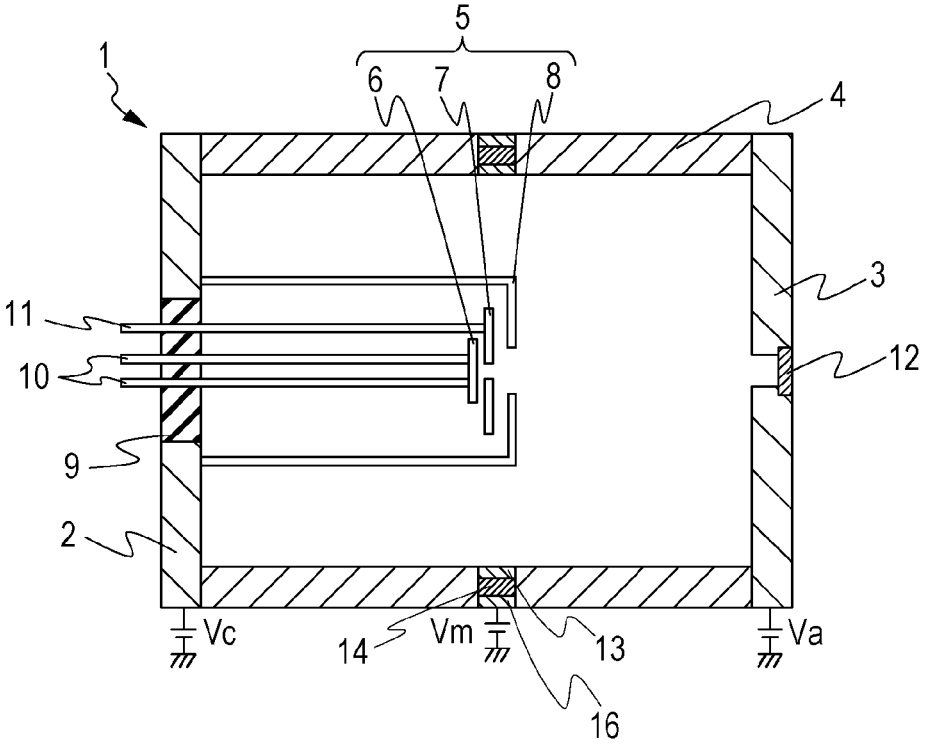
FIG. 2 is a schematic sectional view illustrating another exemplary radiation generating tube of the present invention.

The second method is to form the electrical resistance member 14 locally in the wall thickness direction of the tubular side wall 4 as illustrated in FIG. 2. Desirably, an electrical potential defining member 16, which is different from the electrical potential defining member 13, is provided for the defining of the potential of the electrical resistance member 14. It is desirable, for example, to dispose the electrical resistance member 14 between the electrical potential defining member 13 which is provided on the inner wall side of the tubular side wall 4 and the electrical potential defining member 16 which is provided on the outer wall side of the tubular side wall 4. In the first method, there is a possibility that secondary electrical discharge occurs at, for example, wiring and thereby electrical circuits are damaged depending on locations. In such a case, it is desirable that the second method is selected.

A method of forming the electrical resistance member 14 may include, as illustrated in FIG. 2, forming a member in which the electrical resistance member 14 is disposed between the electrical potential defining member 13 and the electrical potential defining member 16, which is another electrical potential defining member, and then connecting the formed member to the tubular side wall 4 by for example, welding.

Another method of forming the electrical resistance member 14 is first doping a conductive substance which contains metallic elements, such as Cr and Fe, in the wall thickness direction of the tubular side wall 4 which is an insulating ceramic material. Then, chromic oxide, iron oxide, etc. are dispersed and contained locally in a portion of the tubular side wall 4 and thus the resistance of the portion is lowered. In this manner, an area which has a predetermined electric constant as relatively low resistance or high inductance to the tubular side wall 4 is formed. In this method, the area at which resistance is lowered by doping to the tubular side wall 4 becomes the electrical resistance member 14. It is also possible to dispose electrode suitable as the electrical potential defining member which defines an electrical potential defining region on the inner wall side or on the outer wall side of the tubular side wall 4 via the above-described low resistive region. Both the low resistive region and the area on which the electrical potential defining member (the electrode) is disposed are desirably disposed symmetrically with respect to a central axis of the tubular side wall 4 seen from the electron source 6 at a position at the same distance from the cathode 2 in the axis direction of the tubular side wall 4 from the viewpoint of the electrostatic voltage withstanding capability. For example, the low resistive region and the area on which the electrical potential defining member is disposed may be formed in a circular form at a position at the same distance from the cathode 2 in the axis direction of the tubular side wall 4. Alternatively, the low resistive region and the area on which the electrical potential defining member is disposed may be discretely disposed at positions at the same distance the cathode 2 in the axis direction of the tubular side wall 4.

Since it is not necessary to form a trimming portion to concentrate stress on the tubular side wall 4 inside which is depressurized and thus atmospheric pressure applied thereto, or it is not necessary to form an interface with other members which are different in linear expansion coefficient, the doping method is desirable method from the viewpoint of reduction in manufacturing process, lowered cost, and reliability in rigidity of the radiation generating tube.

As insulating ceramics, alumina and zirconia may be used. Desirably, from the viewpoint of voltage withstanding capability, the ceramic has insulating property as volume resistivity of equal to or greater than $1\times10^6$ Ωm or has dielectric property as specific inductive capacity equal to or lower than 20. Doping against the insulating ceramic tubular side wall 4 may be made in any method: examples thereof include bubble jet (registered trademark) system, inkjet, ion plating, spattering and deposition. Any dopant may be used as long as it is configured to apply electrical conductivity to the insulating tubular side wall 4 in the wall thickness direction. For example, semimetals, such as Sb and Mg, metal, and metal oxide may be used suitably. Transition metal or oxides of transition metal may be used desirably for their thermal stability and highly reproducible resistance values. For example, Fe, Ti, Y, Cr, Zr, Ru and oxides thereof may be used.

The electric resistance value of the electrical resistance member 14 or the inductor 15 is desirably equal to or greater than 100 kΩ. If the electric resistance value is equal to or greater than 100 kΩ, the discharge current may be reduced. More preferably, the electric resistance value of equal to or greater than 1 MΩ may reduce the discharge current even more effectively. If the inductance value of the inductor 15 or the electrical resistance member 14 is desirably equal to or greater than 10 mH. If the inductance value is equal to or greater than 10 mH, the discharge current may be reduced. More preferably, the inductance value of equal to or greater than 100 mH may reduce the discharge current even more effectively.

Figure 3:
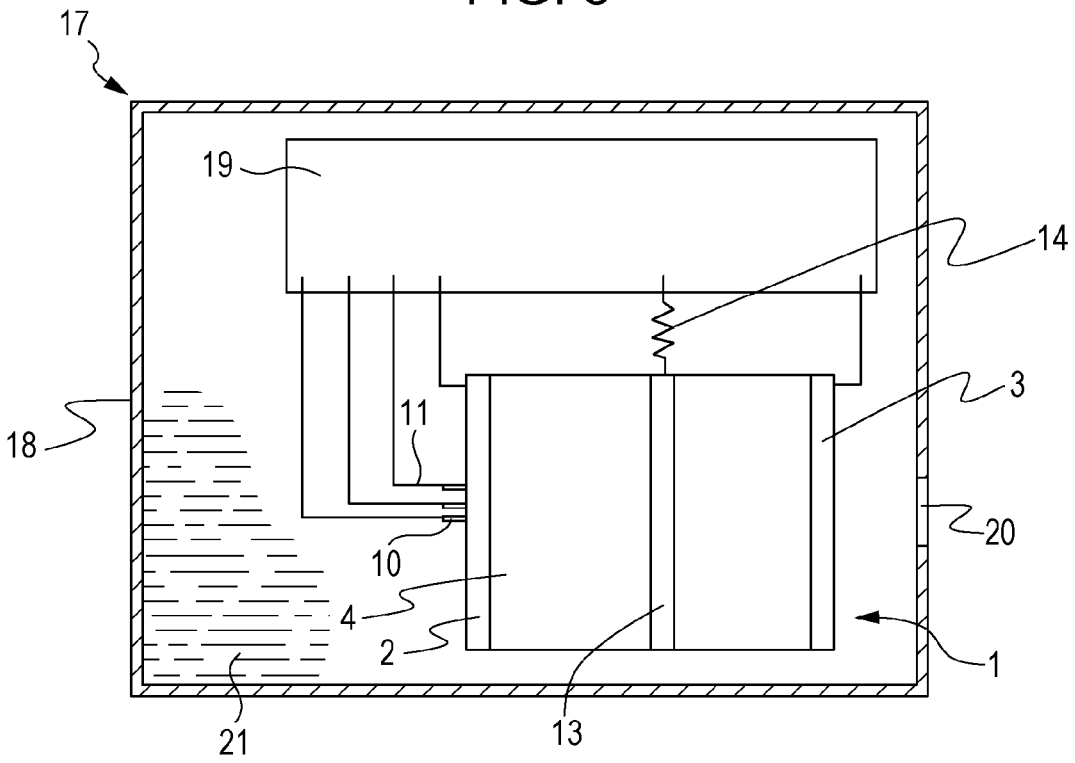
FIG. 3 is a schematic diagram of radiation generating apparatus in which the radiation generating tube of the present invention is used.

Radiation generating apparatus 17 may be manufactured using the radiation generating tube 1. The radiation generating apparatus 17 in which the radiation generating tube 1 of the present invention is used is illustrated in a schematic diagram in FIG. 3. The radiation generating apparatus 17 includes the radiation generating tube 1 and a power circuit 19 which is electrically connected to the radiation generating tube 1. In the radiation generating apparatus 17, the radiation generating tube 1 and the power circuit 19 are disposed in a housing 18. The housing 18 includes a radiation output window 20 disposed at a position in accordance with the position of the target 12 (not illustrated) of the radiation generating tube 1. The housing 18 is filled with an insulating fluid 21, such as insulation oil, and is sealed. The cathode 2, the anode 3, the terminal for driving the electron source 10, the terminal for grid electrode 11 and the electrical potential defining member 13 are connected to the power circuit 19. Potential of these constituents is defined suitably. In FIG. 3, the electrical potential defining member 13 is electrically connected to the power circuit 19 via the electrical resistance member 14. The electrical resistance member 14 may be replaced with the inductor 15. The power circuit 19 includes a voltage source (not illustrated) as an electrical potential defining unit of the electrical potential defining member 13.

FIRST EXAMPLE

A first example, which is one of the exemplary configurations described above, will be described with reference to FIG. 1A. FIG. 1A is a schematic cross-sectional view of a radiation generating tube 1 along a central axis of a tubular side wall 4. A radiation generating tube 1 of the present example includes a cathode 2, an anode 3, the tubular side wall 4, an electron gun structure 5, an insulating member 9, a terminal for driving the electron source 10, a terminal for grid electrode 11, a target 12, an electrical potential defining member 13 and an electrical resistance member 14. The electron gun structure 5 includes an electron source 6, a grid electrode 7 and a focusing electrode 8.

The cathode 2, the anode 3 and the electrical potential defining member 13 are made of Kovar. The tubular side wall 4 and the insulating member 9 are made of alumina. These constituents are fixed to each other by welding. The tubular side wall 4 is cylindrical in shape. The electron source 6 is a cylindrical-shaped impregnated cathode including an impregnated electron emitting portion (emitter), and is fixed to an upper end of a cylindrical sleeve. A heater is disposed in the sleeve. When the heater is supplied with current from the terminal for driving the electron source 10, the cathode is heated and the electrons are emitted. The terminal for driving the electron source 10 is brazed to the insulating member 9.

The target 12 is brazed to the anode 3 as a 5-μm-thick tungsten film formed on a 0.5-mm-thick silicon carbide substrate.

In the electron gun structure 5, the electron source 6, the grid electrode 7 and the focusing electrode 8 are arranged in this order toward the target 12. The grid electrode 7 is supplied with current from the terminal for grid electrode 11 and extracts the electrons efficiently from the electron source 6. In the similar manner to the terminal for driving electron source 10, the terminal for grid electrode 11 is brazed to the insulating member 9. The focusing electrode 8 is welded to the cathode 2 and its potential is defined to the same as that of the cathode 2. The focusing electrode 8 narrows the beam diameter of the electron beam extracted by the grid electrode 7 and makes the electron beam efficiently collide with the target 12.

The cathode 2, the anode 3 and the tubular side wall 4 have the same outer diameter of ϕ60 mm and the same inner diameter of ϕ50 mm. The focusing electrode 8 is substantially cylindrical in outer shape and is ϕ25 mm in diameter. The cathode 2, the anode 3, the tubular side wall 4 and the focusing electrode 8 are arranged coaxially to each other. The tubular side wall 4 is divided into two by the electrical potential defining member 13 which is disposed at an intermediate portion in the axis direction. The entire length of the tubular side wall 4 is 70 mm. The electrical potential defining member 13 is formed as a ring which is ϕ60 mm in outer diameter, ϕ50 mm in inner diameter and 5 mm in thickness. The electrical potential defining member 13 is fixed to the tubular side wall 4 at a position 35 mm from the cathode 2 (i.e., 30 mm from the anode 3).

With the application of heat, the radiation generating tube 1 is vacuum-sealed through an unillustrated exhaust tube which is welded to the cathode 2.

By the method described above, the radiation generating tube 1 illustrated in FIG. 1A is manufactured. The radiation generating tube 1 is subject to high voltage in insulation oil. The cathode 2 is grounded. The anode 3 is connected to a high-voltage power supply and pressure is raised to 100 kV. The electrical potential defining member 13 is defined to be one-fifth the potential of the potential of the anode 3 via the electrical resistance member 14 disposed outside the radiation generating tube 1. The electric resistance value of the electrical resistance member 14 is set to 100 kΩ. The total number of discharging events up to 100 kV in this case is almost the same as that of a case in which no electrical resistance member 14 is provided. However, it has been learned that the discharge current which flows into the focusing electrode 8 from the electrical potential defining member 13 is reduced.

Radiation generating apparatus 17 illustrated in FIG. 3 is manufactured using the radiation generating tube 1 of this example. The electric resistance value of the electrical resistance member 14 is set to 100 kΩ also in this example. The potential of the cathode 2 is set to −50 kV. The potential of the anode 3 is set to 50 kV. The potential of the electrical potential defining member 13 is set to −30 kV. Radiation is successively emitted using the manufactured radiation generating apparatus 17 without any disturbance of electrical discharge.

SECOND EXAMPLE

A second example differs from the first example in that an inductor 15 is provided in place of the electrical resistance member 14 as illustrated in FIG. 1B.

The same examination as that of the first example is carried out using this radiation generating tube 1 with the inductance value of the inductor 15 being set to 10 mH. A discharge current which flows into the focusing electrode 8 from the electrical potential defining member 13 is reduced in the same manner as in the first example.

Further, in the same manner as in the first example, radiation is emitted successfully by the radiation generating apparatus 17 manufactured using the radiation generating tube 1 without any disturbance of electrical discharge.

THIRD EXAMPLE

A third example differs from the first example in that, as illustrated in FIG. 2, the electrical resistance member 14 is disposed between the electrical potential defining member 13 and an electrical potential defining member 16, which is another electrical potential defining member. The electrical resistance member 14 is made of a conductive ceramic in which metallic oxide particles are dispersed. The ceramic material is machined into a ring shape. The electrical potential defining member 13 is attached to the ring-shaped ceramic material on an inner wall side of the tubular side wall 4. The electrical potential defining member 16 is attached to the ceramic material on the outer wall side of the tubular side wall 4. The thus-prepared member is formed to connect the tubular side wall 4 and the electrical potential defining member 16. The electric resistance value of the electrical resistance member 14 is set to about 1 MΩ.

In the thus-manufactured radiation generating tube 1, the same examination as that of the first example is carried out. In this example, the resistance of the electrical resistance member 14 has been increased. Although the total number of discharging events up to 100 kV in this example is almost the same as that of the first example, it has been learned that the discharge current which flows into the focusing electrode 8 from the electrical potential defining member 13 is further reduced.

Further, radiation is emitted successfully by the radiation generating apparatus 17 manufactured using the radiation generating tube 1 without any disturbance of electrical discharge.

FOURTH EXAMPLE

In a fourth example, the tubular side wall 4 is made of alumina. Before assembly to other constituents, such as the cathode and the anode, an area corresponding to the area at which the electrical resistance member 14 is disposed in the first example is doped with iron oxide through ion plating and baking processes. In this manner, a low resistive region is formed. This low resistive region becomes the electrical resistance member 14. The electrical potential defining member 13 is disposed on the inner wall side, and the electrical potential defining member 16 is disposed on the outer wall side of the tubular side wall 4 in a circular form via the low resistive region. The resistance value of the thus-manufactured tubular side wall 4 is, at a portion between the electrical potential defining member 13 and the electrical potential defining member 16, is 120 kΩ.

In the thus-manufactured radiation generating tube 1, the same examination as that of the first example is carried out. In this example, the resistance of the electrical resistance member 14 has been increased. Although the total number of discharging events up to 100 kV in this example is almost the same as that of the first example, it has been learned that the discharge current which flows into the focusing electrode 8 from the electrical potential defining member 13 is further reduced.

Further, radiation is emitted successfully by the radiation generating apparatus 17 manufactured using the radiation generating tube 1 without any disturbance of electrical discharge.

FIFTH EXAMPLE

Figure 4:
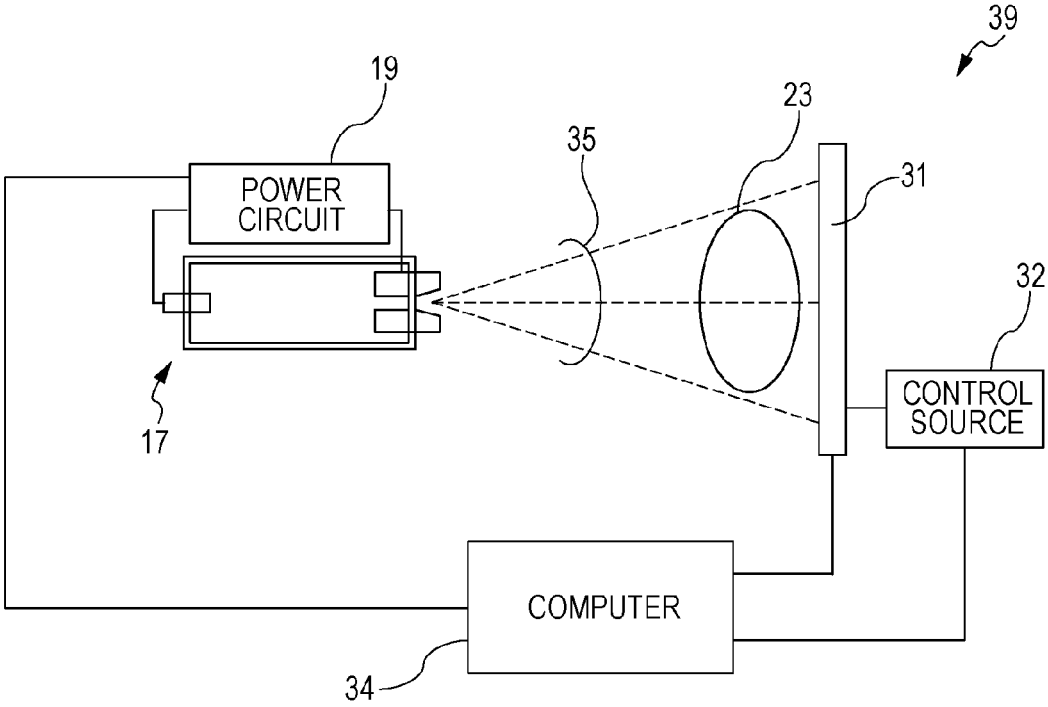
FIG. 4 is a schematic diagram of radiographic apparatus in which the radiation generating apparatus of the present invention is used.

A fifth example is radiographic apparatus 39 which includes the radiation generating apparatus 17 of the first example, a radiation detector 31 and a computer 34. The radiation detector 31 detects at least a part of the radiation generated by the radiation generating apparatus 17. The computer 34 is connected to the radiation detector 31. FIG. 4 is a schematic diagram of radiographic apparatus of the present example.

The radiation generating apparatus 17 is driven by the power circuit 19 for the radiation generating apparatus and generates radiation 35. Under the control of a control source 32, the radiation detector 31 takes information of a picked image of a sample 33 located between the radiation detector 31 and the radiation generating apparatus 1. The taken information of the picked image is transmitted to the computer 34 from the radiation detector 31. The radiation generating apparatus 17 and the radiation detector 31 are controlled in a cooperated manner in accordance with a targeted image to be picked up, such as a still image and a moving image, and in accordance with positions to be picked up. The computer 34 may also carry out image analysis and comparison with previous data.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-252500 filed Nov. 18, 2011, which is hereby incorporated by reference herein in its entirety.

What is claimed is:

1. A radiation generating tube, comprising:

a cathode connected to an electron gun including an electron emitting portion;

an anode including a target and configured to generate radiation when irradiated with electrons emitted from the electron emitting portion;

an insulating tube having a pair of tube ends, one end of which is connected to the cathode and the other end is connected to the anode to surround the electron gun; and an electrical potential defining member disposed in a wall of the insulating tube at an intermediate position between the pair of tube ends of the insulating tube, wherein:

the electrical potential defining member is electrically connected to an electrical potential defining unit via an electrical resistance member or an inductor, and a potential of the electrical potential defining member is higher than that of the cathode and is lower than that of the anode.

2. The radiation generating tube according to claim 1, wherein the electrical resistance member or the inductor is disposed outside the radiation generating tube.

3. The radiation generating tube according to claim 1, wherein the electrical potential defining member includes an inner electrical potential defining member provided on an inner surface of the wall of the insulating tube and an outer electrical potential defining member provided on an outer surface of the wall of the insulating tube, and wherein the electrical resistance member or the inductor is disposed between the inner electrical potential defining member and the outer electrical potential defining member.

4. The radiation generating tube according to claim 3, wherein the electrical resistance member or the inductor is an area in which a conductive substance is contained locally in the wall of the insulating tube.

5. The radiation generating tube according to claim 1, wherein an electric resistance value of either the electrical resistance member or the inductor is equal to or greater than 100 kΩ.

6. The radiation generating tube according to claim 5, wherein an electric resistance value of either the electrical resistance member or the inductor is equal to or greater than 1 MΩ.

7. The radiation generating tube according to claim 1, wherein inductance of either the electrical resistance member or the inductor is equal to or greater than 10 mH.

8. The radiation generating tube according to claim 7, wherein inductance of either the electrical resistance member or the inductor is equal to or greater than 100 mH.

9. A radiation generating apparatus, comprising:

a radiation generating tube as defined in claim 1; and a power circuit electrically connected to the radiation generating tube.

10. The radiation generating apparatus according to claim 9, comprising a housing in which at least the radiation generating tube and the power circuit are stored.

11. A radiographic system, comprising:

a radiation generating apparatus as defined in claim 9;

a radiation detector for detecting at least a part of the radiation emitted by the radiation generating apparatus; and a computer connected to the radiation detector.

12. The radiation generating tube according to claim 1, wherein the target includes a target layer and a substrate, the target layer containing a target metal which emits the radiation when irradiated with electrons, and the substrate transmitting the emitted radiation.

13. The radiation generating tube according to claim 12, wherein the target metal includes metallic elements of atomic number 26 or higher.

14. The radiation generating tube according to claim 13, wherein the target metal is at least one of tungsten, molybdenum, chromium, copper, cobalt, iron, rhodium, rhenium, or an alloy thereof.

15. The radiation generating tube according to claim 12, wherein the substrate is formed by at least one of diamond, aluminum nitride and silicon nitride.

16. The radiation generating tube according to claim 1, wherein the electrical potential defining member is located between the electron emitting portion and the target, and is disposed symmetrically with respect to a central axis of the insulating tube.

* * * * *